United States Patent [19]

Giros

[11] 4,203,540

[45] May 20, 1980

[54] APPARATUS AND METHOD FOR TREATMENT OF ELONGATED FLEXIBLE MATERIAL

[76] Inventor: Marcel Giros, Route de Saint-Dizier, Ancerville, France, 55170

[21] Appl. No.: 941,187

[22] Filed: Sep. 11, 1978

[30] Foreign Application Priority Data

Sep. 22, 1977 [FR] France ..... 77 29100

[51] Int. Cl.[2] ..... B65H 17/42

[52] U.S. Cl. ..... 226/119; 226/42; 226/168

[58] Field of Search ..... 226/118, 42, 108, 117, 226/119, 168, 188, 203; 242/55.01, 182, 183, 184, 79, 82

[56] References Cited

U.S. PATENT DOCUMENTS

| | | | |
|---|---|---|---|
| 3,439,851 | 4/1969 | Rum | 226/168 X |
| 3,462,979 | 8/1969 | Ziegler | 242/55.01 X |
| 3,951,322 | 4/1976 | Giros | 226/119 |
| 4,026,450 | 5/1977 | Giros | 226/119 |

*Primary Examiner*—Edward J. McCarthy
*Attorney, Agent, or Firm*—Otto John Munz

[57] ABSTRACT

An apparatus for the treatment of a flexible material of great length in a treatment volume, comprising means for giving the material the form of a helix comprising several turns, means for causing this helix to progress or advance in the treatment volume by being driven by rotating supporting shafts and means for regulating the speed of entry of the material into the volume and also its speed of progression the treatment volume comprising at least two treatment chambers disposed side-by-side, the entry of the material into one chamber being substantially opposite the exit of the material from the following chamber, and means appropriate for guiding the material from one chamber to the following chamber without driving the said material, wherein said means for guiding said material are formed of a tunnel equiped with two trains of idler rollers.

In a preferred mode of treatment, when using an apparatus of which the treatment volume comprises two separate chambers disposed side-by-side, the exit speed of the material from the second chamber is smaller than or equal to the entry speed of the material into the first chamber which is smaller than the peripheral speed of the shafts of the first chamber, this latter being smaller than the peripheral speed of the shafts of the second chamber.

7 Claims, 8 Drawing Figures

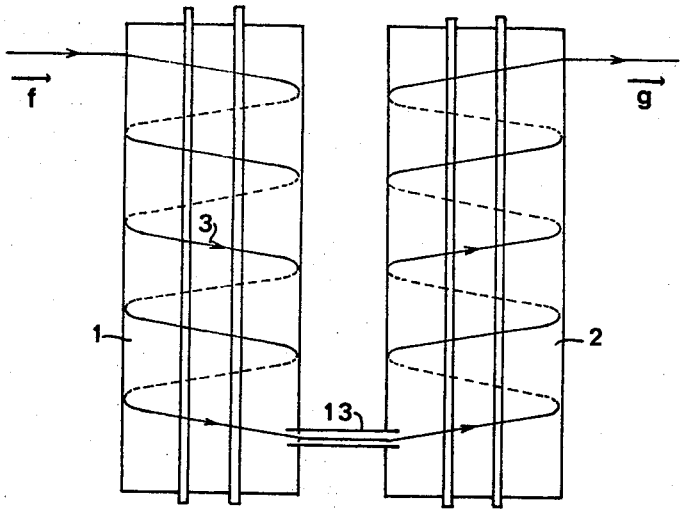
Fig. 2
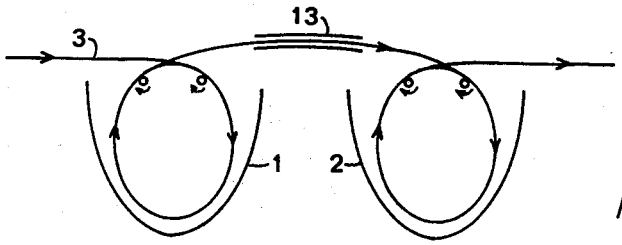
Fig. 3
Fig. 8
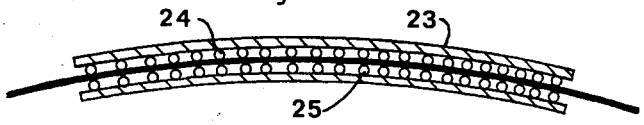

APPARATUS AND METHOD FOR TREATMENT OF ELONGATED FLEXIBLE MATERIAL

BACKGROUND OF THE INVENTION

1. Field of the Invention

Apparatus for conveying coiled elongated flexible materials such as wires, tubes, strips and section members in general which are for example made of metal in successive treatment chambers and method for using such apparatus.

2. Description of the Prior Art

For treating a material, such as one of those mentioned above, it has been known for many years to cause the material to advance in a treatment chamber (single or multiple) in the form of helical turns carried by rotating shafts. Driving means ensure the introduction of the material at the inlet to the chamber and other driving means ensure its extraction at the outlet. One of the permanent difficulties existing with this type of treatment method is to ensure the regularity of the turns of the helix in order to avoid a sudden "tangling" ; such an incident would necessitate the complete stoppage of the treatment for a time which may amount to several hours. U.S. Pat. No. 4,026,450 describes a method by which is obtained an excellent regularity of the turns of the helix. It consists in using systematically and efficiently, contacts (which are called "transient" contacts) of the material with the walls of the treatment chamber in causing an alternation of normal running conditions, during which the length of the material increases slowly in the chamber, with adjustment running conditions, during which this length decreases suddenly, thereby taking up the excess in length which has occurred during normal running conditions. The alternation of these running conditions is obtained by an adequate regulation of the peripheral speeds of the supporting shafts, of the speed of the material at the outlet and of its speed at the inlet.

Even although the method of the aforementioned U.S. patent resolves the problem as regards the regular nature of the turns and permits a continuous operation without any risks, it does not always provide a very satisfactory solution to the completely different problem of fitting in an already existing factory (or in an already constructed building) the corresponding treatment installations, this problem being due particularly to the length dimension of several tens of meters, which is required in the case of complex treatments, or of the treatment volumes themselves where wide strips are involved.

SUMMARY OF THE INVENTION

The primary objects of the invention are to resolve the two problems set out above, namely: reduction in size and regular nature of operation. In order to achieve this, it is proposed to use an apparatus in which the treatment volume is divided into at least two juxtaposed chambers and to bring into operation two types of running conditions, of which one is for the speed of entry of the material into one chamber and the other is for the speed of exit from the following chamber, and the peripheral speeds of the shafts in each chamber are connected by a relationship which will be hereinafter indicated.

Another object of the invention is to provide an apparatus which provides the advantage of causing the material, after treatment, to leave along a path which may be a prolongation of the path of entry. Thus, a material which does not have to be treated (in the case of a manufacture of welded tubes, starting from strips which are generally hot-rolled and thus are to be cleaned, but which in exceptional cases may be cold-rolled and are thus already cleaned) may advance along the most direct path and without in any way passing into the treatment volume, the installations of which may, during this time, be very conveniently inspected, repaired or modified.

Another object of the invention is to provide and apparatus with which it is possible for the material, after treatment, to be caused to leave along a path parallel to the entry path, but in an opposite direction.

Another object of the invention is to provide means for guiding the material as it passes from one chamber to the other. These means only assure the guiding action, without any driving or braking by friction being caused and thus without any risk of the material becoming deformed. The said means are preferably formed by a tunnel, adapted to the section of the material undergoing treatment, and disposed either above or below the chambers, or even following an S-shaped path, passing beneath one of the said chambers. The tunnel preferably comprises internally two trains of superposed idler pulleys or rollers, between which travels the material passing from one chamber to the other and, as indicated above, without being driven or braked.

Yet another object of the invention is to provide a method of using an apparatus such as previously described, which seeks to assure automatic regularity in operation. This method comprises the alternation of normal running conditions, during which the length of the material in the volume is increased, and second running conditions, referred to as adjustment running conditions, during which the length of the material in the volume decreases. Such a method is described in connection with an apparatus having a single treatment volume in U.S. Pat. No. 4,026,450. The method of the present invention, for an apparatus of which the treatment volume comprises two separate chambers disposed side-by-side, is characterised in that, during normal running conditions, the exit speed of the material from the second chamber ($V_S$) is smaller than or equal to the entry speed of the material into the first chamber ($V_e$) which is smaller than the peripheral speed of the shafts of the first chamber ($\omega_e r_e$), this latter being smaller than the peripheral speed of the shafts of the second chamber ($\omega_S r_S$), and this may be represented by the formula $$V_S \leqq V_e < \omega_e r_e < \omega_S r_S$$

When the relative speed conditions as indicated above are achieved, experience shows that the retrograde waves being established in the second chamber under the effect of the fleeting contacts of the material with the downstream wall of the chamber (a phenomenon described in the previously mentioned U.S. patent in respect of a single chamber) are not only propagated in this chamber, but also go back to the first chamber. By virtue of this judicious choice of the speeds, there is thus obtained an automatic regulation of the turns in the entire treatment volume.

The invention is intended to include the case where the last chamber in which the material is travelling does not comprise a treatment or rinsing bath, but is the tank of a storage unit, such as described for example in French Pat. No. 2169531, and the term "treatment chamber" thus includes a storage chamber.

Other objects of the invention and the many of its advantages will become obvious to those skilled in the art from the following description taken in conjunction with the appended drawings and claims.

BRIEF DESCRIPTION OF THE DRAWINGS

FIGS. 2 and 3 are respectively a partial diagrammatic plan view and partial diagrammatic sectional view of the apparatus of FIG. 1.

FIG. 8 is a longitudinal section of a guiding tunnel.

DESCRIPTION OF THE PREFERRED EMBODIMENTS

Figure 1:
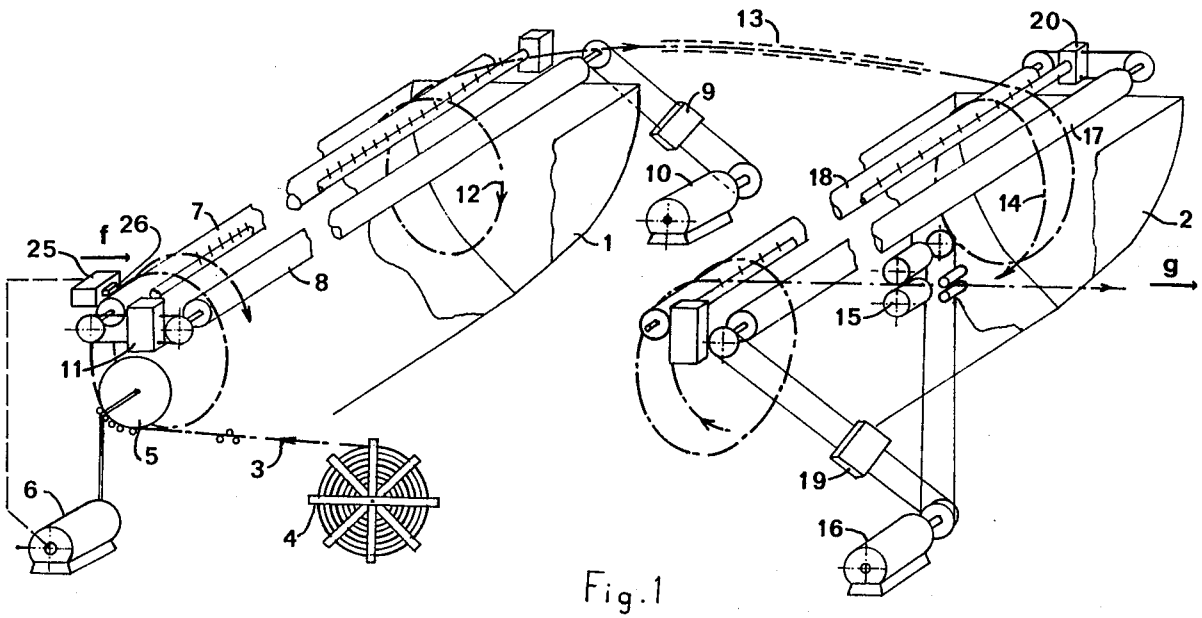
FIG. 1 is a perspective view of an apparatus according to the invention, comprising two treatment chambers.

FIG. 1 shows an apparatus comprising two treatment chambers 1 and 2, disposed in parallel relation and side-by-side. A long product 3, stored on a reel 4, passes into a helix-forming device 5, driven by a motor 6, and enters the chamber 1 in the direction of the arrow f. The product is supported and driven by two shafts 7 and 8. The shaft 8 is itself rotated by a device 9 under the action of a motor 10. A movement-transfer device 11 connects the shaft 7 to the shaft 8 and assures the coordination of the movements of the two shafts. Operation and stop of motor 6 are controlled by a sensing element 25 provided with a contact 26. Action of the first loop of the coiled material on contact 26 and sensing element 25 is described in detail in U.S. Pat. No. 4,026,450.

The long product 3 is displaced in the form of helical turns 12 in the chamber 1. At the outlet, it passes into a guiding tunnel 13, which will be described in detail by reference to FIG. 8, in which it is moved without being either driven or deformed.

On leaving the tunnel 13, the long product enters the chamber 2, in which it is moved in the form of helical turns 14 and from which it is extracted by extraction means 15 (which in this case are rollers) driven by a motor 16. The motor 16 also ensures the rotation of supporting shafts 17 and 18 by a driving arrangement 19, which acts on the shaft 17. A movement-transfer device 20 connects the shaft 18 to the shaft 17. It can be seen that the said two shafts 17 and 18 turn in the same direction as the shafts 7 and 8. This direction is indicated by the two arrows provided on the turns 12 and 14. It can also be seen that the long product 3, because of the manner in which the apparatus of the invention is arranged, leaves the said apparatus in a direction indicated by the arrow g, which is substantially an extension of the direction of the arrow f indicating the direction in which the product enters the first chamber 1.

FIGS. 2 and 3 are two diagrammatic views of the apparatus shown in FIG. 1, in which the two chambers 1 and 2 and also the long product 3 have been respectively shown in plan and in section. The helical turns which are formed by the said product have been arbitrarily spaced from one another in FIG. 2 so as to enable a better reading of the drawing. It is seen that, in this constructional form, the guiding tunnel 13 is disposed above the space separating the two chambers 1 and 2.

Figure 4:
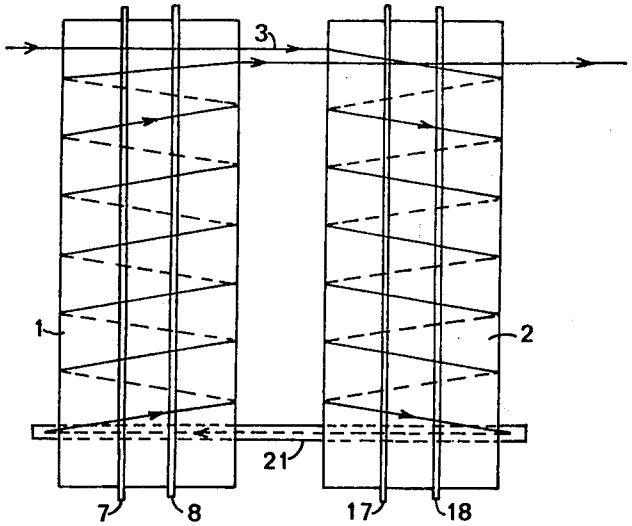
Figure 5:
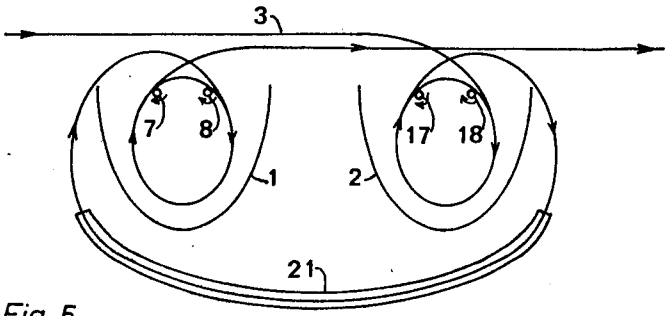

FIGS. 4 and 5 are two diagrammatic views of an alternative apparatus, with the two chambers 1 and 2 and the long product 3 shown in plan view and in section, respectively. In the constructional form as represented, the guiding tunnel 21 is disposed beneath the two chambers 1 and 2; in this case, the shafts 7 and 8, on the one hand, and the shafts 17 and 18, on the other hand, also all rotate in the same direction indicated by the small arrows of FIG. 5.

Figure 6:
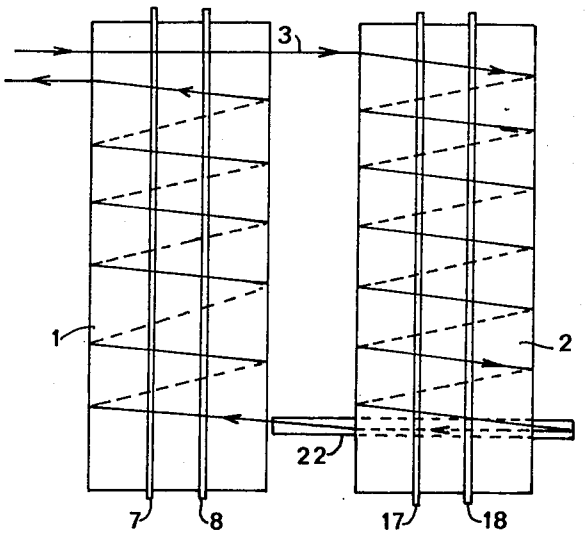
FIGS. 4 to 7 are views similar to FIGS. 2 and 3 of other constructional forms of the apparatus according to the invention.
Figure 7:
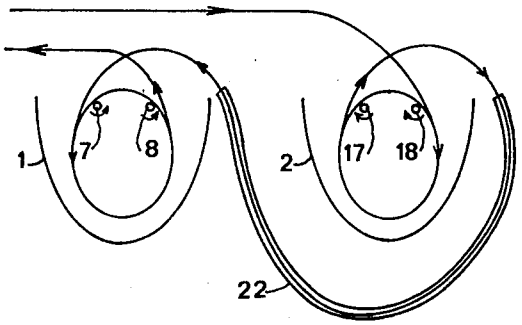

FIGS. 6 and 7 are two diagrammatic views of a further alternative apparatus, in which the two chambers 1 and 2 and the long product 3 are, as previously represented in plan view and in section, respectively. However, in this constructional form of the apparatus, a guiding tunnel 22 connects the space which is between the two chambers 1 and 2 to a space externally of the chamber 2. In addition, it is here provided by the invention that the shafts 7 and 8, on the one hand, and the shafts 17 and 18, on the other hand, rotate in opposite directions. It is then apparent that the long product 3 leaves the apparatus directed towards the region from which it came when it entered.

FIG. 8 shows a guiding tunnel, utilized in the several embodiments shown comprising two trains of rollers 24 and 25 in a curved tube 23. The long product rolls on these roller trains without being driven and without any friction.

I claim:

1. An apparatus for treatment of a flexible material of great length in a treatment volume, comprising means for giving the material the form of a helix comprising several turns, means for causing this helix to progress or advance in the treatment volume by being driven by rotating supporting shafts and means for regulating the speed of entry of the material into the volume and also its speed of progression the treatment volume comprising at least two treatment chambers disposed side-by-side, the entry of the material into one chamber being substantially opposite the exit of the material from the following chamber, and means appropriate for guiding the material from one chamber to the following chamber without driving the said material, wherein said means for guiding said material are formed of a tunnel equipped with two trains of idler rollers.

2. An apparatus as claimed in claim 1 wherein the direction of rotation of the supporting shafts is the same in each of the chambers.

3. An apparatus as claimed in claim 2 wherein said tunnel is disposed above the space separating two successive chambers.

4. An apparatus as claimed in claim 2 wherein said tunnel is disposed below two successive chambers.

5. An apparatus as claimed in claim 1 comprising two chambers wherein the direction of rotation of the shafts of the first chamber is opposite to the direction of rotation of the shafts of the second chamber.

6. An apparatus as claimed in claim 5 wherein said tunnel has the general form of an S connecting the space between two successive chambers to the space externally of one of them, passing below this latter chamber.

7. Method of treating a flexible material of great length in a treatment volume, comprising the following operations: giving the material the form of a helix having several turns, causing this helix to advance in the treatment volume by being driven by supporting shafts, and regulating the mean linear speed of the material in the volume to equality with the speed of exit from the volume by alternation of normal running conditions, during which the length of the material in the volume is increased, and second adjustment running conditions, during which the length of the material in the volume decreases, wherein the treatment volume comprises a first chamber forming a first part thereof and a second chamber forming a second part thereof and the method further comprises passage of the material through the first chamber followed by passage through the second chamber, the directions of progression of the material in the two chambers being opposite to one another, during normal running conditons the speed of exit of the material from the second chamber ($V_S$) being smaller than or equal to the speed of entry of the material into the first chamber ($V_e$), this latter being smaller than the peripheral speed of the shafts of the first chamber ($\omega_e r_e$), which latter speed is smaller than the peripheral speed of the shafts of the second chamber ($\omega_S r_S$), which may be represented by the formula $$V_S \leqq V_e < \omega_e r_e < {}_S r_S \omega.$$

* * * * *